US008224191B2

(12) United States Patent
Asaka

(10) Patent No.: US 8,224,191 B2
(45) Date of Patent: Jul. 17, 2012

(54) IMAGE FORMING APPARATUS

(75) Inventor: Hitoshi Asaka, Chuo-ku (JP)

(73) Assignee: Kyocera Mita Corporation, Osaka (JP)

( * ) Notice: Subject to any disclaimer, the term of this patent is extended or adjusted under 35 U.S.C. 154(b) by 854 days.

(21) Appl. No.: 12/291,882

(22) Filed: Nov. 14, 2008

(65) Prior Publication Data

US 2009/0129791 A1 May 21, 2009

(30) Foreign Application Priority Data

Nov. 16, 2007 (JP) ..... 2007-297476
Nov. 16, 2007 (JP) ..... 2007-297477

(51) Int. Cl.
*G03G 15/00* (2006.01)

(52) U.S. Cl. ..... 399/11; 399/27; 399/115; 399/172

(58) Field of Classification Search ..... 399/9, 11, 399/24, 26, 27, 31, 34, 38, 71, 75, 100, 115, 399/168, 170–172
See application file for complete search history.

(56) References Cited

U.S. PATENT DOCUMENTS 5,223,895 A * 6/1993 Saitoh ..... 399/24
5,717,974 A * 2/1998 Park ..... 399/24
2006/0159484 A1* 7/2006 Nakayama ..... 399/100

FOREIGN PATENT DOCUMENTS

JP 2006-178265 7/2006

* cited by examiner

*Primary Examiner* — David Porta
*Assistant Examiner* — Benjamin Schmitt
(74) *Attorney, Agent, or Firm* — Jordan and Hamburg LLP

(57) ABSTRACT

A main control section 41 displays a prompt for cleaning of a discharge wire 15-2 to a user together with a prompt for maintenance work for replacement of a toner container (consumable item) 21 to the user on a display screen of a touch panel section 53, for example, when a replacement timing of the toner container (consumable item) 21 that has been reached is detected. The user who sees the content of the display carries out cleaning work of the discharge wire 15-2 at the same time with maintenance work for replacement of the toner container 21. This can contribute to an improvement in user convenience and also increase the operating capacity of an apparatus body to the extent possible.

1 Claim, 6 Drawing Sheets

IMAGE FORMING APPARATUS

BACKGROUND OF THE INVENTION

1. Field of the Invention

The present invention relates to an image forming apparatus utilizing an electrophotographic process such as a copier, a printer, a facsimile machine or the like, and in particular, to an image forming apparatus capable of contributing to an improvement in user convenience and increasing the operating capacity of an apparatus body to the extent possible.

2. Description of the Related Art

A corona charger is provided to an image forming apparatus utilizing an electrophotographic process such as a copier, a printer, a facsimile machine or the like. The corona charger is provided in the vicinity along a rotation axis direction of a photosensitive drum on which an electrostatic latent image is formed. The corona charger has a function of applying a predetermined potential to a surface of the photosensitive drum by corona discharge. In order to achieve this charging function, a discharge wire is laid across the corona charger, along the rotation axis direction of the photosensitive drum.

In this corona charger, floating toner within the image forming apparatus, gaseous products in conjunction with discharge, etc., are easily adhered to the discharge wire. As a result, there is a problem that the discharging function is gradually reduced as the image forming processing is performed repeatedly.

As one of the approaches for solving such a problem, the present inventor proposes a wire cleaning mechanism configured to include a grid cleaner which is fixed with a fixing holder of an apparatus body and has a wet sponge provided so as to be opposed to a grid, and remove extraneous matter while the wet sponge contacts with the surface of the grid by sliding the charger (see Japanese Published Unexamined Patent Application No. 2006-178265, for example). According to this wire cleaning mechanism, reliable cleaning of the grid is possible with a simple configuration, and occurrence of leakage due to entry of moisture inside the charger can be obviated.

On the other hand, it is necessary to power off the apparatus body once when cleaning work of the discharge wire is carried out, in general. Thus, a user who powers on the apparatus body after the cleaning work of the discharge wire is carried out cannot use the apparatus until its operation is stabilized. As a result, there is room for improvement from the perspective that user convenience is lost and also the operating capacity of the apparatus is improved.

SUMMARY OF THE INVENTION

Accordingly, it is an object of the present invention to obtain an image forming apparatus capable of contributing to an improvement in user convenience and increasing the operating capacity of the apparatus to the extent possible.

In order to achieve the foregoing object, a principal feature of the configuration of an image forming apparatus according to the present invention includes a cylindrical photosensitive drum on which an electrostatic latent image is formed, a shield member provided in the vicinity along a rotation axis direction of the photosensitive drum and having an opposite face side to the photosensitive drum opened, a discharge wire laid across the shield member along the rotation axis direction of the photosensitive drum, a timing detection section detecting a maintenance timing of a consumable item associated with image forming, a display section configured to be able to display various information including a prompt for maintenance work of the consumable item to a user on a display screen, and a display control section making a determination on whether maintenance of the consumable item is required, based on a detection result in the timing detection section, and when a determination that maintenance of the consumable item is required is made as a result of the determination, performing control of displaying a prompt for cleaning work of the discharge wire to the user together with a prompt for the maintenance work of the consumable item to the user on the display screen of the display section.

DETAILED DESCRIPTION OF THE PREFERRED EMBODIMENTS

Hereinafter, an image forming apparatus according to an embodiment of the present invention is described in detail with reference to the drawings.

First, a general structure around a photosensitive drum provided to the image forming apparatus according to the embodiment of the present invention is described with reference to FIG. 1.

Figure 1:
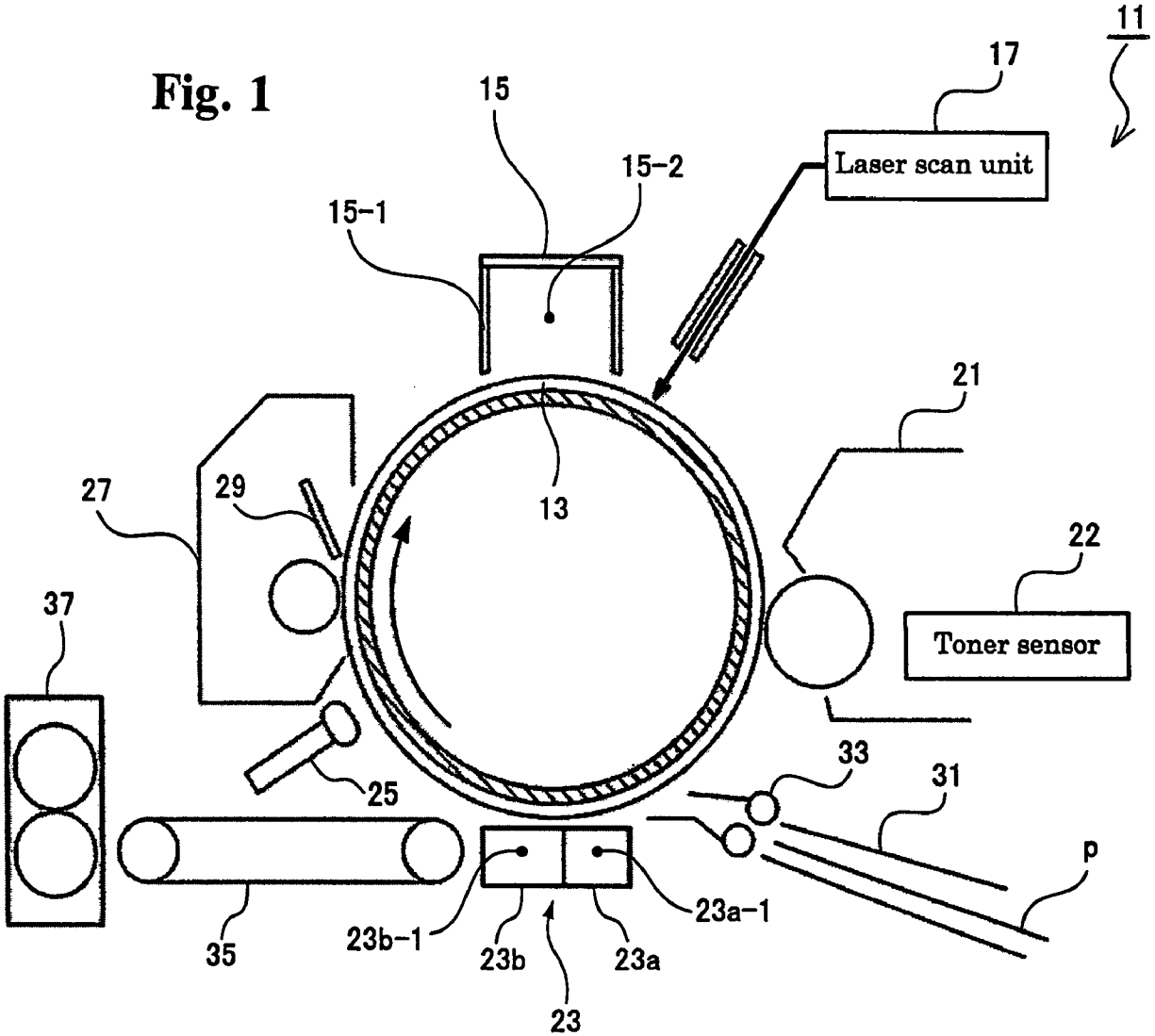
FIG. 1 is a front sectional view showing a general structure around a photosensitive drum provided to an image forming apparatus according to an embodiment of the present invention.

As shown in FIG. 1, the image forming apparatus 11 according to the embodiment of the present invention is composed of a cylindrical electrophotographic photosensitive drum (hereinafter, referred to as a 'photosensitive drum') 13 made of a metal base and from its directly above position toward a clockwise direction, a charger 15, a laser scan unit 17, a development unit 21, a transfer unit 23, a neutralization unit 25 and a cleaning unit 27 so as to be arranged along a circumferential surface of the photosensitive drum 13, respectively.

The photosensitive drum 13 is used when an electrostatic latent image and a toner image in line with the electrostatic latent image are formed on the circumferential surface thereof.

The charger 15 has a function of forming uniform electric charges on the circumferential surface of the photosensitive drum 13 that rotates clockwise. The charger 15 is configured to include a shield member 15-1 which is arranged at a position near the photosensitive drum 13 and toward which the photosensitive drum 13 is opened, and a discharge wire 15-2 laid across the shield member 15-1 along a rotation axis direction of the photosensitive drum 13. In the charger 15 according to the embodiment, a corona discharge method of applying electric charges on the circumferential surface of the photosensitive drum 13 by corona discharge from the discharge wire 15-2 is adopted.

The laser scan unit 17 has a function of forming an electrostatic latent image on the circumferential surface of the photosensitive drum 13 by irradiating the circumferential surface of the rotating photosensitive drum 13 with a laser beam modulated based on image data of a document having been read, for example, by a scanner (not shown) thereby removing electric charges on the irradiated portion.

The development unit 21 has a function of forming a toner image on the circumferential surface of the photosensitive drum 13 through supplying toner to the circumferential surface of the photosensitive drum 13 thereby adhering the toner to a portion where the electrostatic latent image is formed during the laser scanning process. The development unit 21 is embodied as a toner container attachably and detachably mounted to the apparatus body and filled with toner for image forming in the embodiment of the present invention. To the toner container (development unit) 21, there is provided a toner sensor (corresponding to a 'timing detection section' of the present invention) 22 detecting a residual toner amount within the container and outputting a toner empty detecting signal when the residual toner amount becomes a predetermined value or less. In the above-described embodiment, the development unit 21 of a type in which a toner cartridge portion for refilling toner is integrally configured and the toner container is replaced in its entirety when the residual toner amount becomes empty is exemplarily described. However, the following configuration may be adopted instead of this embodiment; a development unit of a type in which a toner cartridge portion is attachably and detachably mounted to another body and only the toner cartridge portion is replaced with a new one when the residual toner amount becomes empty, or a development unit of a type in which a toner bottle for refilling is attachably and detachably mounted to another body and toner is refilled into the toner bottle when the residual toner amount becomes empty.

The transfer unit 23 is composed of a transfer charger 23*a* and a detach charger 23*b*. The transfer unit 23 has a function of transferring the toner image having been formed on the circumferential surface of the photosensitive drum 13 in the developing process to a sheet of paper P having been fed to a position just below the photosensitive drum 13 and also detaching the sheet of paper P having been transferred.

The neutralization unit 25 has a function of performing neutralization by irradiating the photosensitive drum 13 with light. As the neutralization unit 25, for example, an LED array irradiating light with a wave length of 660 nm can be used.

The cleaning unit 27 has a function of scraping off and cleaning the toner remaining on the circumferential surface of the photosensitive drum 13 by a blade 29 after the transferring process. The circumferential surface of the photosensitive drum 13 having been cleaned by the cleaning unit 27 heads for a charged region in the charger 15 again for the next image forming processing, and the same processing is to be repeated hereafter.

In the normal image forming processing, the above configured image forming apparatus 11 is charged by the charger 15 and an electrostatic latent image is formed by light irradiated from the laser scan unit 17. The electrostatic latent image is developed by the development unit 21, and the toner image is transferred on the sheet of transfer paper P having been conveyed from a transfer paper feeding system 31 via a resist roller 33 in the transfer charger 23*a*. The transferred sheet of transfer paper P is separated by the detach charger 23*b*, passes through a transfer paper conveying system 35, reaches the fixing unit 37 and is fixed there and then discharged outside the apparatus. On the other hand, the toner image remaining on the surface 13*b* of the photosensitive drum 13 after the transferring process is diselectrified by the neutralization unit 25 and then scraped off by the blade 29 of the cleaning unit 27. The image forming apparatus 11 operates to undergo the each of the above processes and terminates a series of the image forming processing.

Now, an electrical configuration in the image forming apparatus according to the embodiment of the present invention is described with reference to FIG. 2 and FIG. 3.

Figure 2:
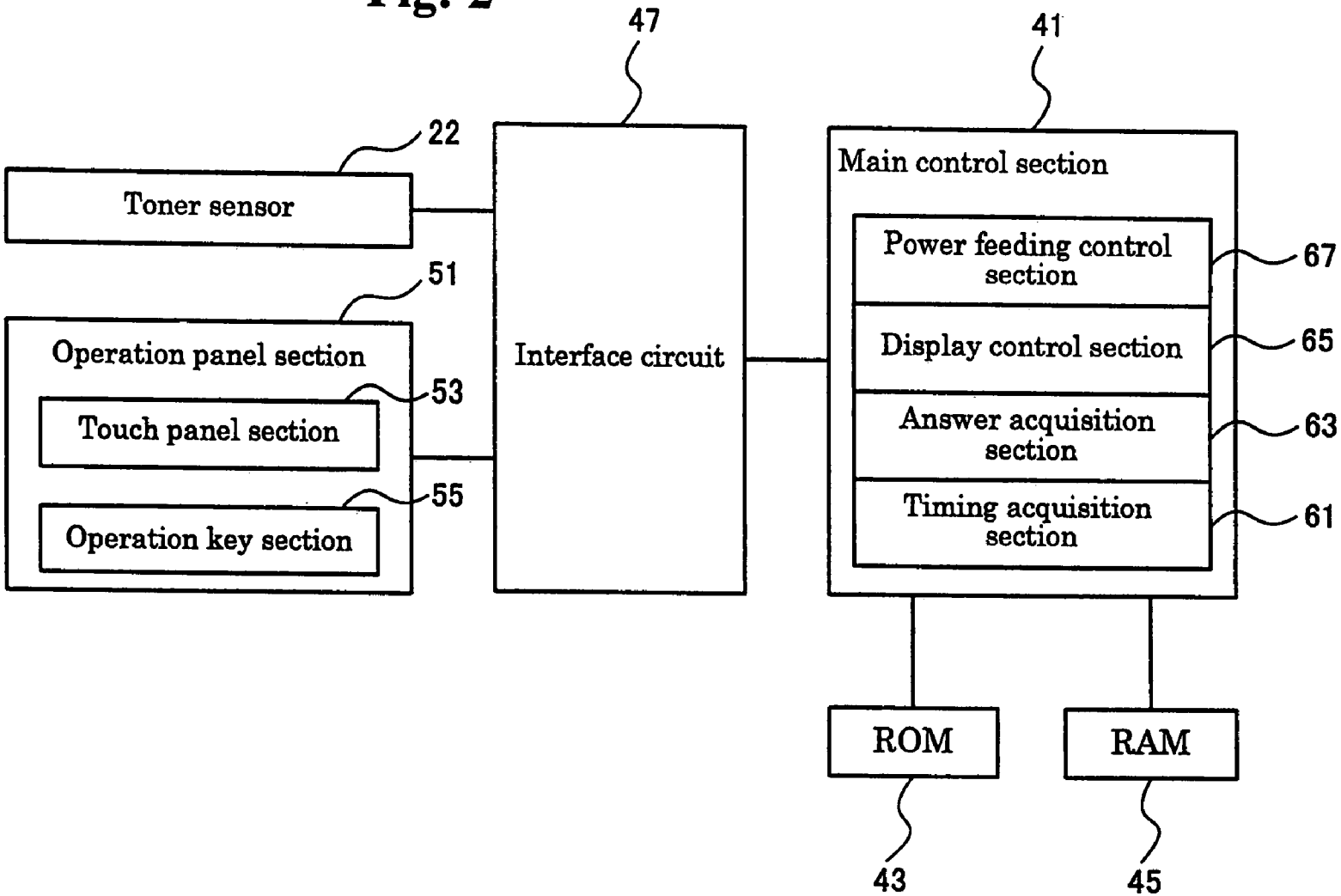
FIG. 2 is a functional block diagram showing an electrical configuration in the image forming apparatus.

As shown in FIG. 2, the image forming apparatus 11 is configured to include a main control section 41 taking charge of power feeding control etc., to predetermined functional sections in the apparatus body, a read-only memory (ROM) 43 for storing a program etc., a random-access memory (RAM) 45 for storing data etc., and an interface circuit 47. The aforementioned toner sensor 22 and the operation panel section 51 are connected to the interface circuit 47, respectively.

Figure 3:
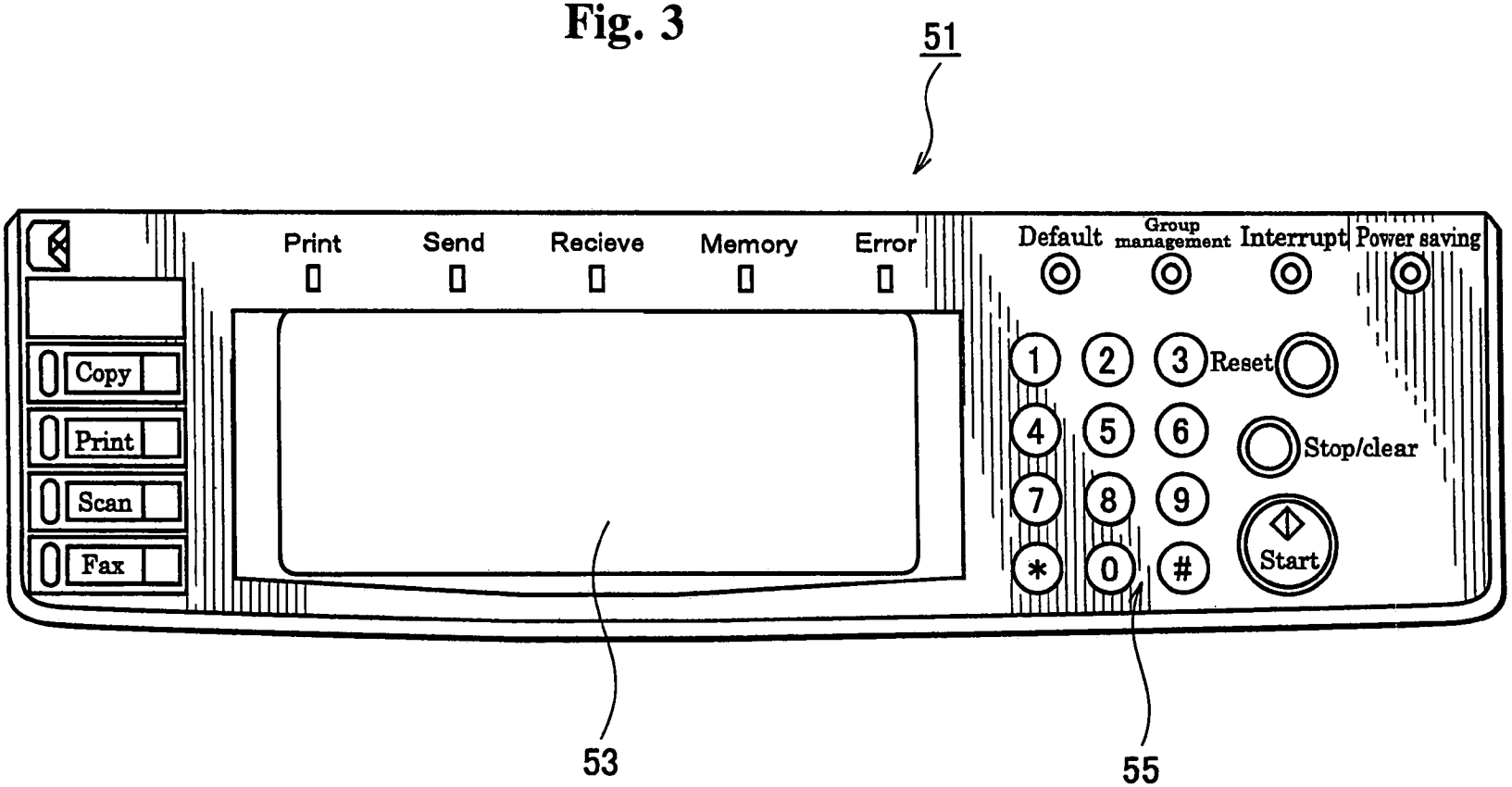
FIG. 3 is an external view of an operation panel section in the image forming apparatus.

The operation panel section 51 includes a touch panel section 53 and an operation key section 55 as shown in FIG. 3. The operation panel section 51 is used in order that a user may conduct an operation related to a facsimile function, a scanner function, a printer function, or a copy function etc. The operation panel section 51 provides the main control section 41 with an operation command, etc., by the user.

The touch panel section (corresponding to a 'display section' of the present invention) 53 is composed of a touch panel unit combined with a touch panel and a color liquid crystal display (LCD). The touch panel section 53 displays various operation screens, for example, information on a document size, a copy size, and the number of copies in executing the copy function, and also displays an operation button and the like in order that the user may input various operation commands by touching a relevant place. The touch panel section 53 is used when a prompt for replacement of a consumable item or cleaning of the discharge wire 15-2 to the user and an inquiry screen etc., prompting the user for an answer as to whether the cleaning work of the discharge wire 15-2 is carried out with use of a wet-type cleaner are displayed on the display screen.

The operation key section 55 includes a plurality of operation keys to accept an operation input by the user. The operation key section 55 is used, for example, when the user selectively executes a key input operation of a necessary function from among various functions such as a facsimile function, a copy function, a printer function and a scanner function. More specifically, for example, the operation key section 55 is used when the user conducts a ten-key input operation to select a facsimile number of a destination machine in using the facsimile function or when the user conducts an input operation of a one touch dial or a speed dial. Further, the operation key section 55 is used when having the user conduct an input operation of his/her answer as to whether cleaning work of the discharge wire 15-2 has been carried out with use of the wet-type cleaner.

On the other hand, in order to achieve the object of contributing to an improvement in user convenience and also increasing the operating capacity of the apparatus to the extent possible, the main control section 41 is configured to include a timing acquisition section 61 that acquires a maintenance timing of a consumable item that has been reached, by receiving a toner empty detecting signal from the toner sensor 22, an answer acquisition section 63 acquiring an answer from a user as to whether cleaning work of the discharge wire 15-2 is carried out with use of a wet-type cleaner, a display control section 65 making a determination on whether maintenance of the consumable item is required, based on a result acquired in the timing acquisition section 61, and when a determination that maintenance of the consumable item is required is made as a result of the determination, performing control of displaying a prompt for cleaning of the discharge wire 15-2 to the user together with a prompt for maintenance work of the consumable item to the user on the display screen of the touch panel section 53, and a power feeding control section 67 making a determination on whether cleaning work of the discharge wire 15-2 is carried out with use of a wet-type cleaner, based on the content of the answer in the answer acquisition section 63, and when a determination that cleaning work of the discharge wire 15-2 is carried out is made as a result of the determination, performing control of halting power feeding to the predetermined functional sections in the apparatus body only for a predetermined stand-by time.

In addition to the aforementioned function, the display control section 65 has another function of performing control of displaying that the apparatus is in stand-by in cleaning work of the discharge wire 15-2 in a count down manner on the display screen of the touch panel section 53, when a determination on whether cleaning work of the discharge wire 15-2 is carried out with use of a wet-type cleaner is made based on the content of the answer in the answer acquisition section 63 and when a determination that cleaning work of the discharge wire 15-2 is carried out is made as a result of the determination.

Now, meanings of terms used in the embodiment of the present invention are described. A concept of a 'consumable item associated with image forming' in the embodiment of the present invention includes, for example, a toner container (development unit) 21, a photosensitive drum cartridge, etc. A concept of maintenance work of a consumable item inclusively includes replacement work of a consumable item such as the toner container (development unit) 21 or photosensitive drum cartridge with a new one or refilling work of a necessary member such as toner when a maintenance timing of the consumable item has been reached.

Figure 5:
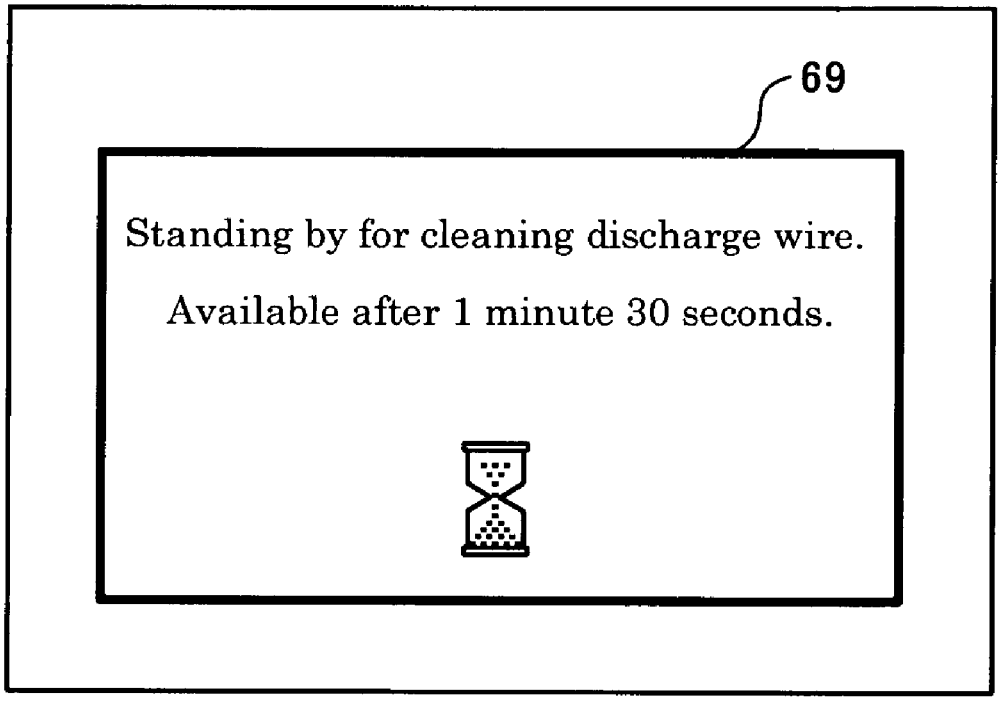
FIG. 5 is an explanatory diagram showing an example of a display screen in which a remaining time until an apparatus body becomes available is displayed as counted down after cleaning of a discharge wire.
Figure 6:
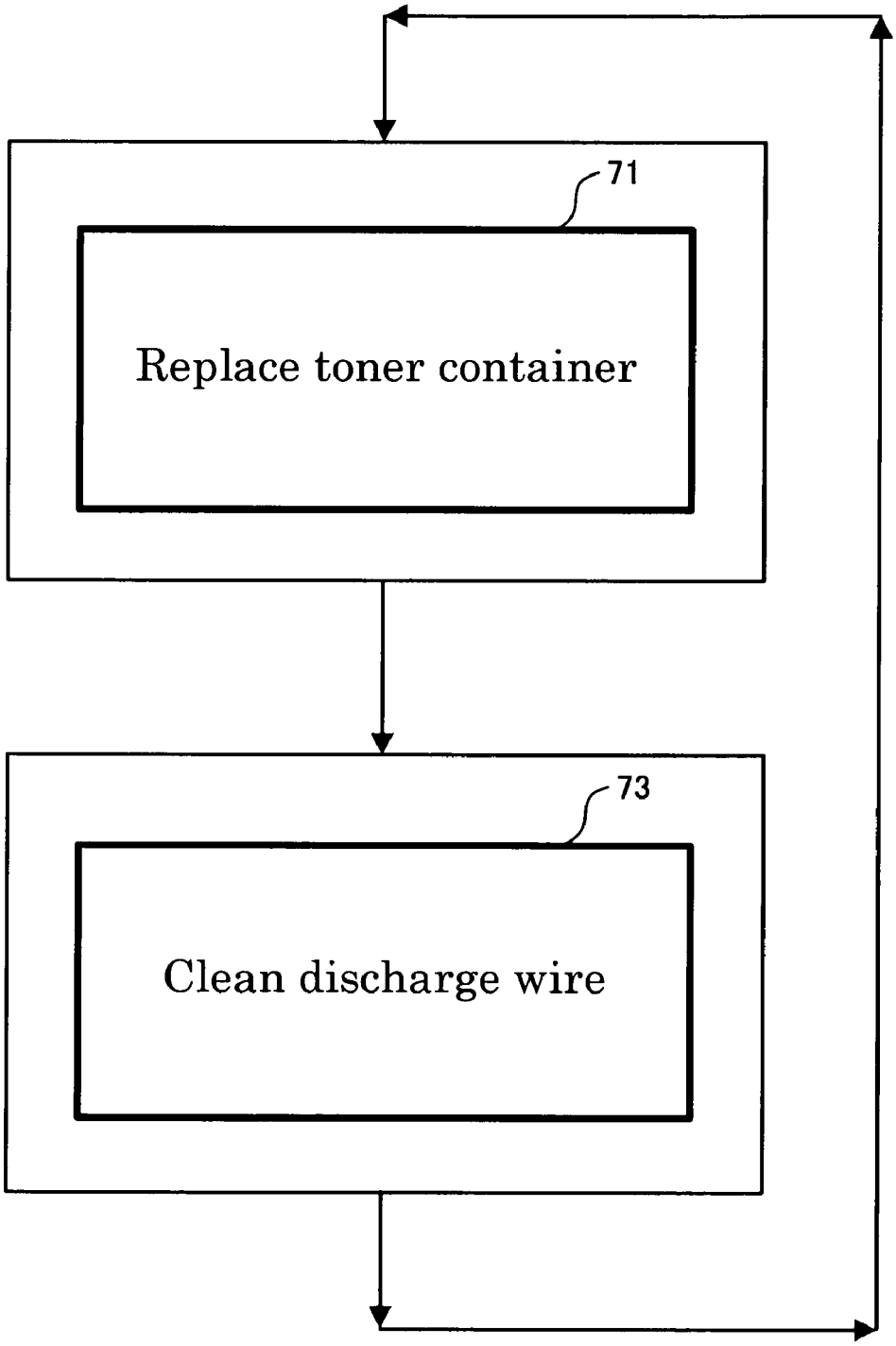
FIG. 6 is an explanatory diagram showing an example of display screens which are presented alternately when maintenance work for toner container replacement and discharge wire cleaning is requested to a user.

Subsequently, an operation of the image forming apparatus according to the embodiment of the present invention is described with reference to FIGS. 4 to 6.

Figure 4:
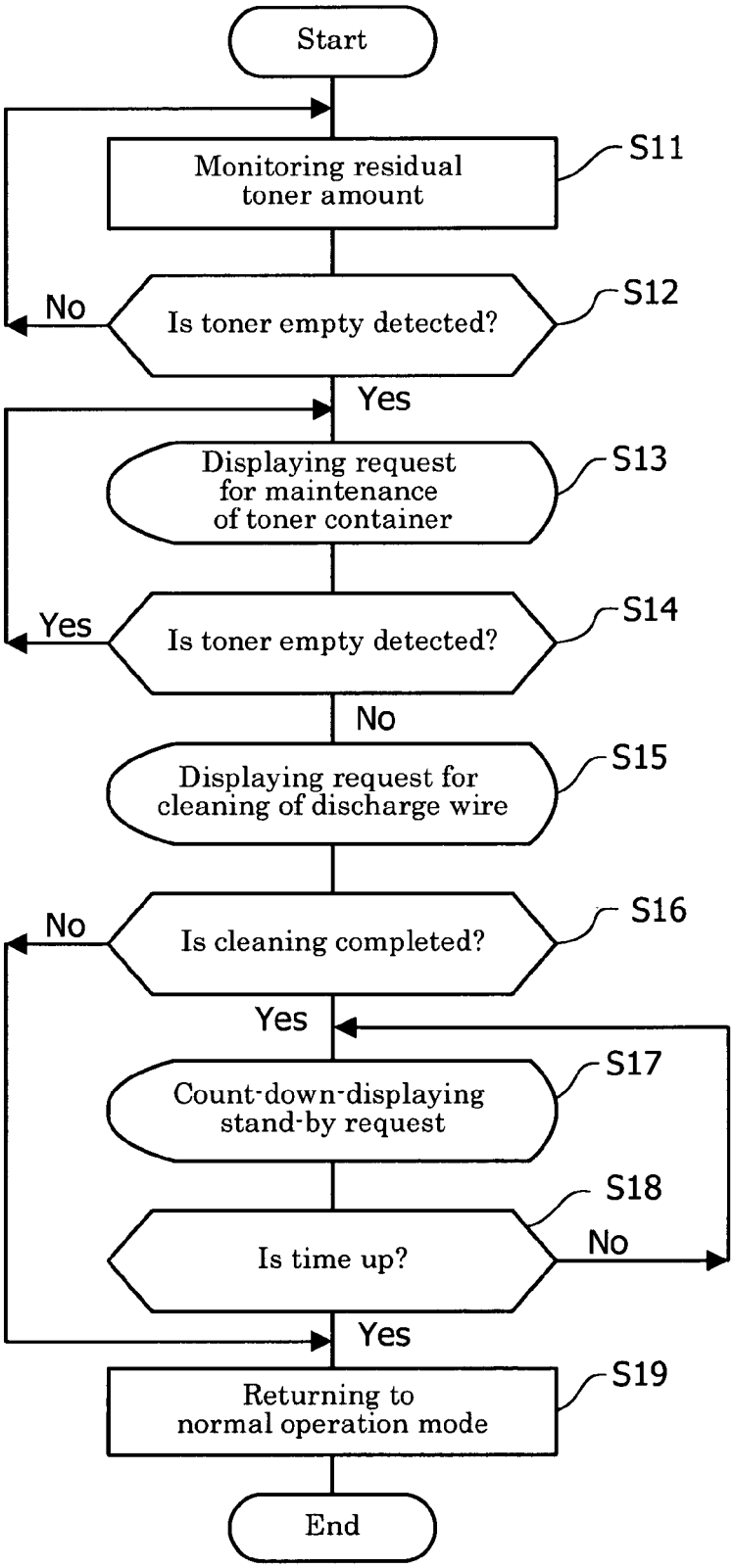
FIG. 4 is an operational flow chart of maintenance work in the image forming apparatus.

As shown in FIG. 4, the main control section 41 monitors a residual toner amount of the toner container 21 (Step S11). Based on a result of the monitoring, the main control section 41 makes a determination on whether the toner container (consumable item) 21 should be replaced. More specifically, when receiving a toner empty detecting signal having been transmitted from the toner sensor 22, that is, the acquired residual toner amount becomes a predetermined value or less and a timing for replacement has been reached (corresponding to 'when a determination that maintenance for a consumable item is required is made' of the present invention) (corresponding to 'yes' in Step S12), the timing acquisition section 61 transfers that effect to the display control section 65.

In response to that, the display control section 65 performs control of displaying a request for replacing the toner container (consumable item) 21 on the display screen of the touch panel section 53 (Step S13). By this means, for example, a message such as 'replace the toner container' is displayed on the display screen of the touch panel section 53.

Subsequently, the main control section 41 makes a determination on whether the replacement of the toner container (consumable item) 21 is completed, based on a monitoring result of the residual toner amount of the toner container 21 (Step S14). More specifically, when the toner empty detecting signal from the toner sensor 22 is no longer received, that is, the residual toner amount becomes a predetermined value or more and the replacement of the toner container is completed is acquired (corresponding to 'no' in Step S14), the timing acquisition section 61 transfers that effect to the display control section 65. The determination on whether the replacement of the toner container 21 is completed may be configured to be made by detecting opening/closing of an apparatus body cover (not shown) opened and closed at the time of replacing the toner container 21.

In response to that, the display control section 65 performs control of displaying a request for cleaning the discharge wire 15-2 on the display screen of the touch panel section 53 (Step S15). By this means, for example, a message such as 'clean the discharge wire' is displayed on the display screen of the touch panel section 53.

Subsequently, the answer acquisition section 63 awaits an answer from the user as to whether the cleaning work of the discharge wire 15-2 is carried out with use of a wet-type cleaner (Step S16). In Step S16, for example, an inquiry screen prompting the user to answer whether the cleaning work of the discharge wire 15-2 is carried out with use of a wet-type cleaner is displayed on the display screen of the touch panel section 53. When the user who sees the inquiry screen operation-inputs that the cleaning work is already carried out (for example operation-inputs 'yes' on the display screen, which corresponds to 'yes' in Step S14) as an answer, the answer acquisition section 63 responds to this and transfers that effect to the display control section 65.

In response to that, the display control section 65 performs control of displaying, on the display screen of the touch panel section 53, that standing by in conjunction with the cleaning work of the discharge wire is required and also a screen for presenting a remaining time of a stand-by time (a time appropriately changeable according to need, for example 5 minutes etc.) in a count down manner (Step S17). By this means, for example, a count-down type presenting screen 69 (see FIG. 5) of a remaining time of the stand-by time such as 'the apparatus becomes available after 1 minute 30 seconds' together with a message such as 'now standing by for cleaning of discharge wire' is displayed on the display screen of the touch panel section 53. The user who sees such a message and count-down type presenting screen 69 can recognize a current situation of the apparatus in full including that the apparatus is in stand-by, its reason and a remaining time of the stand-by time. Thus, the user will no longer feel frustration such as 'why is the apparatus unavailable?' or 'how long must I wait?'

On the other hand, the power feeding control section 67 performs control of halting power feeding to predetermined functional sections in the apparatus body only for the aforementioned stand-by time as well as the display control of the stand-by message and the count-down type presenting screen 69 in Step S17.

Now, the purpose of performing the power feeding control to predetermined functional sections is described. It can be conceived that moisture remains on the discharge wire 15-2 and its peripheral portions after the cleaning work of the discharge wire 15-2 is carried out with use of a wet-type cleaner. In such a case, there is a possibility of leading to the occurrence of leakage derived from residual moisture to the functional sections when power supply is conducted to each functional section without performing power feeding control at all and with the power feeding kept on. On the other hand, there arises a problem from the perspective of improvement in availability of the apparatus body when a long-term stand-by time is set in order to avoid the leakage. Hence, the power feeding control section 67 is configured to perform control of automatically halting power feeding to the predetermined functional sections in the apparatus body only for a predetermined stand-by time in response to the answer from the user that the cleaning work of the discharge wire 15-2 is carried out with use of a wet-type cleaner.

For the predetermined stand-by time, appropriately set is a time totaling a necessary drying time taken for the moisture adhered to the discharge wire 15-2 and its peripheral portions to be dried and a necessary operation stabilizing time taken by the time the operation of the apparatus body becomes stable when power feeding to the predetermined functional sections in the apparatus body is conducted after the necessary drying time elapses.

Thus, the image forming apparatus 11 according to the embodiment of the present invention can contribute to an improvement in user convenience and also increase the operating capacity of the apparatus body to the extent possible through automatically setting an appropriate stand-by time and performing power feeding control to the predetermined functional sections in the apparatus body even when power-on is attempted after cleaning work of the discharge wire 15-2 is carried out with use of a wet-type cleaner.

While performing display control of the stand-by message and the count-down type presenting screen 69 in Step S17 and the power feeding control to the predetermined functional sections in the apparatus body, the main control section 41 refers to a remaining time of the stand-by time on a count-down timer (not shown), thereby making a determination on whether a predetermined stand-by time elapses (time is up) (Step S18). The processing from Step S17 to Step S18 is repeatedly performed until the predetermined stand-by time elapses.

When a determination that the predetermined stand-by time elapses is made, as a result of the determination in Step S18, the main control section 41 returns the operation mode of the apparatus body to the normal operation mode (Step S19) and then terminates a series of the processing. Following that the operation mode of the apparatus body is returned to the normal operation mode, the display control section 65 performs control of displaying to that effect on the display screen of the touch panel section 53. By this means, for example, a message such as 'copying available' is displayed on the display screen of the touch panel section 53. The user who sees this message finds that the apparatus is restored to an available state and can have the apparatus perform an operation of a necessary job.

In the image forming apparatus 11 according to the embodiment of the present invention, as described above, for example, when replacement timing of the toner container (consumable item) 21 that has been reached is detected, a prompt for its maintenance work to the user as well as a prompt for cleaning of the discharge wire 15-2 to the user are displayed on the display screen. The user who sees the content of the display carries out the cleaning work of the discharge wire 15-2 at the same time with the maintenance work for replacement of the toner container 21. Here, it is necessary to power off the apparatus once when the replacement of the toner container 21 or the cleaning work of the discharge wire 15-2 is carried out. Thus, the embodiment of the present invention in which replacement of the toner container 21 and cleaning work for the discharge wire 15-2 are carried out around the same time allows a valid operating capacity time of the apparatus to be longer compared with when they are carried out individually. Therefore, the image forming apparatus 11 according to the embodiment of the present invention can contribute to an improvement in user convenience and also increase the operating capacity of the apparatus body to the extent possible through prompting the user to carry out cleaning work of the discharge wire 15-2 together with maintenance work of the toner container (consumable item) 21.

Further, exceptionally superior availability increasing effects of the apparatus can be expected in an image forming apparatus in which a replacement cycle of the toner container (consumable item) 21 and a cycle required for cleaning work of the discharge wire 15-2 are very close.

Further, managing to enclose a manual for cleaning work of the discharge wire 15-2 into an individual package box (for example, a corrugated box) in which a new toner container 21 is stored contributes to relief of user's dissatisfaction such as having no idea about a procedure for the cleaning work.

On the other hand, in the image forming apparatus 11 according to the embodiment of the present invention, when the user input-operates through the operation panel section 51 an answer that cleaning work of the discharge wire 15-2 is carried out with use of a wet-type cleaner after the cleaning work of the discharge wire 15-2 is carried out with use of the wet-type cleaner, power feeding to the predetermined functional sections in the apparatus body is to be halted only for a predetermined stand-by time based on the content of the answer. Thus, the image forming apparatus according to the present invention can contribute to an improvement in user convenience and also increase the operating capacity of the apparatus body to the extent possible through setting an appropriate stand-by time and performing power feeding control to predetermined functional sections in the apparatus body even when power-on is attempted after the cleaning work of the discharge wire 15-2 is carried out with use of a wet-type cleaner.

Since the configuration of prompting to carry out cleaning work of the discharge wire 15-2 at the same time with maintenance work for replacement of the toner container 21 is adopted in the image forming apparatus 11 according to the embodiment of the present invention, a counter for counting the number of copies is not required separately and periodic cleaning work of the discharge wire can be carried out with a remarkably simple configuration.

The present invention should not be restricted to the aforementioned embodiment and can be modified appropriately without departing from the spirit or technical idea of the present invention understood entirely from the claims and the specification. Image forming apparatuses with such modifications are also to fall within the technical scope of the present invention.

More specifically, for example, the example of executing a replacement request display of the toner container 21 in Step S13 and then executing a cleaning request display of the discharge wire in Step S15 sequentially is described in the embodiment of the present invention. However, the present invention should not be restricted to the embodiment, and may be configured to display a replacement request of the toner container 21 and a cleaning request of the discharge wire simultaneously on the display screen of the touch panel section 53. Other than that, as shown in FIG. 6 for example, a configuration of displaying a replacement request display screen 71 of the toner container 21 and a cleaning request display screen 73 of the discharge wire are displayed alternately on the display screen of the touch panel section 53 at predetermined time intervals such as 2 seconds, for example, may be adopted.

Further, the present invention is applicable to image forming apparatuses adopting every cleaning method including an image forming apparatus installed with a manual discharge wire cleaning mechanism, for example.

Lastly, the example of prompting to carry out cleaning work of the discharge wire 15-2 at the same time with maintenance work for replacement of the toner container 21 without requiring a counter for counting the number of copies separately is described in the embodiment of the present invention. However, the present invention should not be limited to the embodiment. More specifically, for example, some of the apparatuses having a function of strictly managing a cleaning work timing of the discharge wire adopt such a configuration that a counter for counting the number of copies is separately provided, the count starts at a time point when cleaning work of the discharge wire is carried out, and a cleaning request display of the discharge wire is executed at predetermined intervals such as once every 2 million copies, for example. The embodiment of the present invention may be configured in combination with such related art. In that case, a count value of the number of copies has only to be reset at '0' which is an initial value, when the cleaning work of the discharge wire 15-2 by the user is carried out as a result of prompting to carry out the cleaning work of the discharge wire 15-2 at the same time with maintenance work for replacement of the toner container 21. If thus configured, a display of requesting the cleaning work of the discharge wire 15-2 by the user can be carried out in just the right proportion at an appropriate timing.

What is claimed is:

1. An image forming apparatus comprising:

a photosensitive drum, that is cylindrical, on which an electrostatic latent image is formed;

a shield member provided in a vicinity along a rotation axis direction of the photosensitive drum and having an opposite face side to the photosensitive drum opened;

a discharge wire laid across the shield member along the rotation axis direction of the photosensitive drum;

a timing detection section detecting a maintenance timing of a consumable item associated with image forming;

a display section configured to be able to display various information including a prompt for maintenance work of the consumable item to a user on a display screen;

a display control section making a determination on whether maintenance of the consumable item is required, based on a detection result in the timing detection section, and when a determination that maintenance of the consumable item is required is made as a result of the determination, performing control of displaying a prompt for cleaning work of the discharge wire to the user together with a prompt for the maintenance work of the consumable item to the user on the display screen of the display section; and an answer acquisition section acquiring an answer from the user as to whether the cleaning work of the discharge wire is carried out with use of a wet-type cleaner; and a power feeding control section making a determination on whether the cleaning work of the discharge wire is carried out with use of a wet-type cleaner, based on the content of the answer in the answer acquisition section, and when a determination that the cleaning work of the discharge wire is carried out is made as a result of the determination, performing control of halting power feeding to predetermined functional sections in an apparatus body only for a predetermined stand-by time.

* * * * *